US009039793B2

(12) United States Patent
Fitzgerald et al.

(10) Patent No.: US 9,039,793 B2
(45) Date of Patent: May 26, 2015

(54) SEPARATION SYSTEM AND METHOD

(75) Inventors: Liam Fitzgerald, Wakefield (GB); Peter Lawson, Doncaster (GB); Mike Lenagh, Wingerworth (GB)

(73) Assignee: RECYCOAL SWITZERLAND S.A. (CH)

( * ) Notice: Subject to any disclaimer, the term of this patent is extended or adjusted under 35 U.S.C. 154(b) by 660 days.

(21) Appl. No.: 13/062,612

(22) PCT Filed: Oct. 14, 2009

(86) PCT No.: PCT/GB2009/051373

§ 371 (c)(1),
(2), (4) Date: May 18, 2011

(87) PCT Pub. No.: WO2010/043901

PCT Pub. Date: Apr. 22, 2010

(65) Prior Publication Data

US 2011/0225879 A1 Sep. 22, 2011

(30) Foreign Application Priority Data

Oct. 15, 2008 (WO) ..... PCT/GB2008/050908

(51) Int. Cl.

| | |
|---|---|
| ***C10L 5/00*** | (2006.01) |
| ***B03B 5/34*** | (2006.01) |
| ***B03B 5/32*** | (2006.01) |
| ***C10L 1/32*** | (2006.01) |
| ***B03B 5/44*** | (2006.01) |
| ***B03B 9/00*** | (2006.01) |

(52) U.S. Cl.

CPC ... *B03B 5/34* (2013.01); *B03B 5/32* (2013.01); *C10L 1/326* (2013.01); *B03B 5/44* (2013.01); *B03B 9/005* (2013.01)

(58) Field of Classification Search

CPC ..... B03B 5/34; B03B 5/32; B03B 5/44; B03B 9/005; C10L 1/326

USPC ..... 209/172; 44/612, 621

See application file for complete search history.

(56) References Cited

U.S. PATENT DOCUMENTS

| | | | | |
|---|---|---|---|---|
| 2,932,395 | A * | 4/1960 | Marot | 209/172.5 |
| 3,687,284 | A * | 8/1972 | Leeman et al. | 209/39 |
| 4,144,164 | A | 3/1979 | Absil et al. | |
| 4,203,831 | A | 5/1980 | Parnaby | |
| 4,325,819 | A | 4/1982 | Altizer | |
| 4,775,464 | A * | 10/1988 | Ferrara et al. | 209/172 |
| 4,802,976 | A * | 2/1989 | Miller | 209/17 |
| 5,794,791 | A * | 8/1998 | Kindig | 209/727 |
| 2006/0207946 | A1 * | 9/2006 | McColl et al. | 210/733 |

FOREIGN PATENT DOCUMENTS

| | | |
|---|---|---|
| GB | 1130339 | 10/1968 |
| GB | 2199518 A | 7/1988 |

OTHER PUBLICATIONS

International Search Report mailed Jan. 27, 2010 issued in International Patent Application No. PCT/GB2009/051373.

* cited by examiner

*Primary Examiner* — James Goloboy
*Assistant Examiner* — Latosha Hines
(74) *Attorney, Agent, or Firm* — Shumaker, Loop & Kendrick, LLP

(57) ABSTRACT

A separation system and method for separating one or more solid fossil fuels from a contaminated source in a liquid medium, the system including primary separation means and secondary separation means, the primary and secondary separation means being arranged to operate with liquid media of differing specific gravities.

20 Claims, 2 Drawing Sheets

SEPARATION SYSTEM AND METHOD

Figure 1:
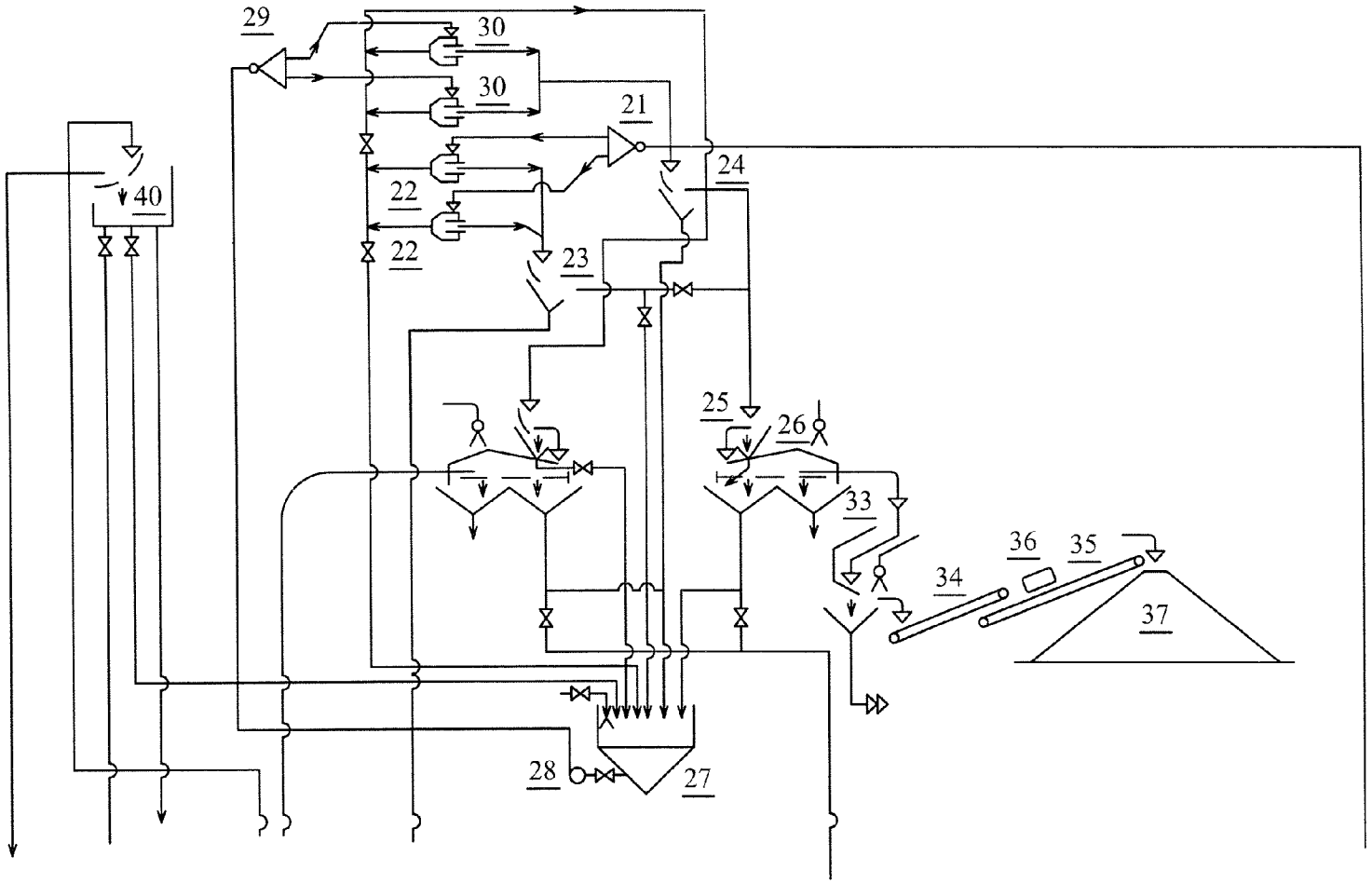
Figure 1:
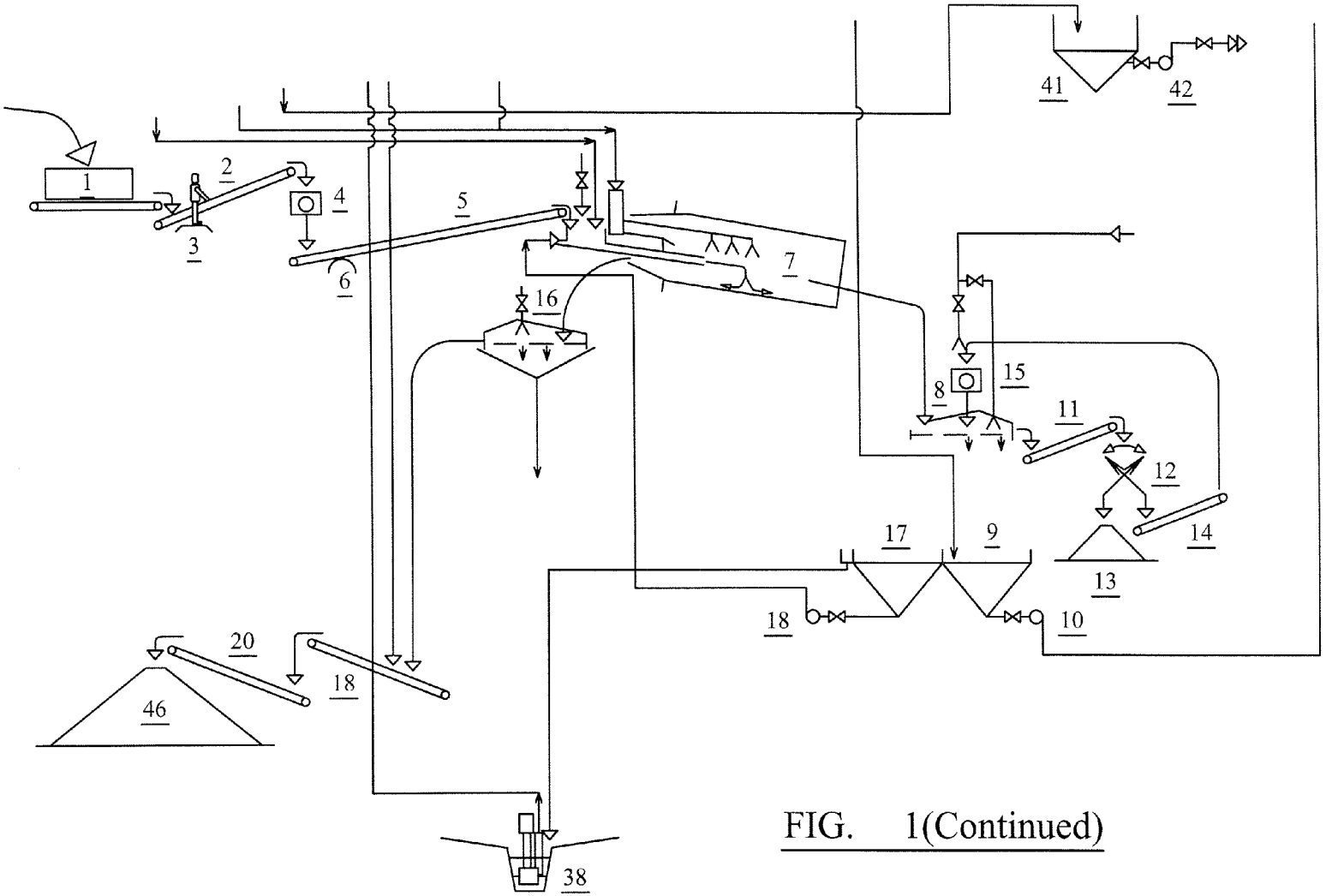

The present invention relates to a separation system and a method of separating, particularly to a separation system and a method of separating coal from a contaminated feedstock.

As coal resources diminish and world demand for coal has increased, as a raw commodity, it has become much more expensive, which is exacerbated by the fact that remaining natural resources are more and more difficult to gain access to, being situated in more and more remote locations.

Coal is used in many industries, particularly in steel making and energy generation. Coal mines throughout the ages have looked to produce the most cost effective and profitable coal that they can. Historically this has resulted in the winning of easy coal with coal bearing dirt (colliery/reject spoil) being dumped into heaps/tips. Through time coal processing was refined and developed and large sophisticated plants incorporated in to the process. The by-products of this process invariably were deposited into the colliery spoil heaps leaving a legacy of contamination. The result of this practice is large derelict colliery heaps with carbon content susceptible to spontaneous combustion along with high levels of compounds which pose environmental and health and safety risks.

Modern day mining in areas where metallurgical coal is the driving force sees millions of tonnes of coal bearing rejects per annum being dumped, the washing process utilised not having the ability to efficiently remove the coal from the fine/small dirt.

In view of the increasing price of raw coal, it would be advantageous if the coal remaining in the spoil/reject heaps could be separated and in the process deal with the contamination within the historical heaps. Furthermore, if such a separation process were efficient and provided clean coal with a high purity, the advantages would be even higher.

It is an object of aspects of the present invention to provide a solution to the abovementioned or other problems.

According to a first aspect of the present invention there is provided a separation system for separating one or more solid fossil fuels from a contaminated source in a liquid medium, the system comprising primary separation means and secondary separation means, the primary and secondary separation means being arranged to operate with liquid media of differing specific gravities.

The primary separation means may comprise a primary cyclone. The secondary separation means may comprise a secondary cyclone.

Preferably, the primary separation means comprises a primary cyclone which is operable to operate at between 10 and 20 psi, more preferably between about 13 and 17 psi and most preferably at about 16 psi. Preferably, the primary separation means comprises a primary cyclone which is adapted to receive a feed material having particulates up to about 50 mm, more preferably up to about 40 mm.

Preferably, the primary separation means comprises a primary cyclone which is operable to discard between about 10 and 100 tonnes per hour, more preferably between about 70 and 90 tonnes per hour. Preferably, the primary separation means comprises a primary cyclone which is operable to separate between about 5 and 50 tonnes per hour of solid fossil fuel, more preferably between about 25 and 35 tonnes per hour of fossil fuel.

Preferably, the secondary separation means comprises a secondary cyclone which is operable to operate at between 10 and 20 psi, more preferably between about 13 and 17 psi and most preferably at about 16 psi. Preferably, the secondary separation means comprises a secondary cyclone which is adapted to receive a feed material having particulates up to about 50 mm, more preferably up to about 40 mm.

Preferably, the secondary separation means comprises a secondary cyclone which is operable to discard between about 10 and 100 tonnes per hour, more preferably between about 70 and 90 tonnes per hour. Preferably, the secondary separation means comprises a secondary cyclone which is operable to separate between about 5 and 50 tonnes per hour of solid fossil fuel, more preferably between about 25 and 35 tonnes per hour of fossil fuel.

Preferably, the primary separation means is arranged to operate with a liquid medium having a specific gravity of between about 1.25 to 1.35, more preferably between about 1.26 to 1.33, more preferably between about 1.27 to 1.30. In a most preferred embodiment, the primary separation means is arranged to operate with a medium having a specific gravity between about 1.28 and 1.29.

Preferably, the secondary separation means is arranged to operate with a medium having a specific gravity of between about 1.15 to 1.249, more preferably between about 1.2 to 1.24, more preferably between about 1.21 to 1.24. In a most preferred embodiment, the secondary separation means is arranged to operate with a medium having a specific gravity between about 1.22 and 1.23.

Specific gravities as disclosed herein are measured at ambient temperature and pressure, ie. 20° C. @ 1 atm.

Preferably, the system further comprises preliminary separation means. The preliminary separation means is preferably operable to rotate, in use, preferably about a longitudinal axis thereof and preferably at a rate of between about 4 and 50 rpm, more preferably between about 15 and 25 rpm, more preferably between about 17 and 23 rpm and most preferably between about 18 and 22 rpm. In a most preferred embodiment, the preliminary separation means is operable to rotate at about 20 rpm. The preliminary separation means may comprise a separating barrel.

The preliminary separation means may be arranged on a slight incline. In other words, a longitudinal axis of the preliminary separation means may be arranged at an angle to the horizontal. Preferably, the longitudinal axis of the preliminary separation means is arranged at between about 5 and 15 degrees to the horizontal, more preferably at between about 8 and 10 degrees to the horizontal and most preferably at about 9 degrees to the horizontal.

The preliminary separation means may comprise washing means, which may comprise means to add liquid to the material to be separated, which liquid is preferably water.

According to a further aspect of the present invention there is provided a method of separating one or more solid fossil fuels from a contaminated source in a liquid medium, the method comprising primary separation of a liquid medium having a first specific gravity followed by secondary separation of the liquid medium at a second specific gravity which second specific gravity differs from the first specific gravity.

Preferably, the second specific gravity differs from the first specific gravity by at least 0.001. Preferably, the second specific gravity differs from the first specific gravity by less than 1. Preferably, the second specific gravity differs from the first specific gravity by between about 0.005 and 0.5, more preferably between about 0.01 and 0.1, most preferably between about 0.02 and 0.08.

Preferably, the first specific gravity is between about 1.25 to 1.35, more preferably between about 1.26 to 1.33, more preferably between about 1.27 to 1.30. In a most preferred embodiment, the first specific gravity is between about 1.28 and 1.29.

Preferably, the liquid medium undergoes specific gravity alteration, preferably after primary separation and before secondary separation, which specific gravity alteration may involve dilution of the medium, preferably with water.

The primary separation may be undertaken in primary separation means. The primary separation means may be as described above with regard to the first aspect.

The secondary separation may be undertaken in secondary separation means. The secondary separation means may be as described above with regard to the first aspect.

Preferably, the second specific gravity is between about 1.15 to 1.249, more preferably between about 1.2 to 1.24, more preferably between about 1.21 to 1.24. In a most preferred embodiment, the second specific gravity is between about 1.22 and 1.23.

The method may also comprise the step of preliminary separation, which preliminary separation may be undertaken in preliminary separation means. The preliminary separation means may be as described above with regard to the first aspect.

According to a further aspect of the present invention there is provided a method of separating coal from a contaminated source, the method comprising adding the coal containing contaminated source to a liquid medium, adjusting the specific gravity of the liquid medium carrying the coal containing contaminated source to a first specific gravity; causing the liquid medium carrying the coal containing contaminated source at the first specific gravity to undergo primary separation; adjusting the specific gravity of the liquid medium carrying the coal containing contaminated source from the primary separator to a second specific gravity, which second specific gravity is different to the first specific gravity; causing the liquid medium carrying the coal containing contaminated source at the second specific gravity to then undergo secondary separation.

Preferably, adjusting the specific gravity of the liquid medium carrying the coal containing contaminated source to a first specific gravity occurs by adding water and mineral dirt.

Preferably, adjusting the specific gravity of the liquid medium carrying the coal containing contaminated source to a second specific gravity occurs by adding water and mineral dirt.

By the term mineral dirt it is meant any of mudstones, shales, coal, sandstone and day, preferably shales.

Preferably, the mineral dirt is obtained from the contaminated source.

According to a further aspect of the present invention there is provided solid fossil fuel obtainable from a system or method of the above aspects.

Preferably, the solid fossil fuel so obtained is at least 95% pure, more preferably at least 97% pure and most preferably at least 98% pure.

All of the features contained herein may be combined with any of the above aspects in any combination.

For a better understanding of the invention, and to show how embodiments of the same may be carried into effect, reference will now be made, by way of example, to the accompanying diagrammatic drawing in which:

FIG. 1 shows a schematic view of a regeneration system.

The process is shown in schematic form, starting at the extreme left of the FIGURE, at the beginning of the process the feed containing fossil fuels and or contaminating compounds is added (shown by arrow marked "FEED IN") to a feeder 1. The feeder 1 comprises a concrete formation within which runs a continuous chain feeder, producing a live feedstock from which material is drawn into the wash process. The feeder 1 is designed for direct loading by dump trucks or loading shovel. The continuous chain feeder is driven through a variable speed hydraulic power pack and motor giving a variable feed rate range of 0-450 tonnes per hour. The feeder 1 delivers feed material onto the Preliminary Feed Conveyor (picking belt 2).

The picking belt 2 is rated to carry a maximum load of 450 tonne per hour and transports the feed material from the Panzer chain feeder 1 to the infeed sizer 4. The picking belt allows a person 3 to manually pick unsuitable contaminants from the picking belt 2.

Material from the picking belt 2 is fed directly into the infeed sizer 4 (twin roll) where any oversized material (rocks, coal lumps, clay and or lumped feed) will be reduced down to −150 mm for the washing process. The feed from the sizer 4 will be discharged directly onto the feed belt 5. The feed belt 5 transports the feed material from the infeed sizer 4 up to a Barrel feed launder at a rate of up to 450 tph.

Material, being 0 to 150 mm in size, from the feed conveyors is discharged into a feed launder where it is washed down the launder into a preliminary separator 7 (a barrel, as defined hereunder), via natural medium, water and shales mixed from the incoming feed to reach a predetermined density (measured as specific gravity), pumped from the launder tank, for preliminary separation.

The preliminary separator is an ATH 2.4 meter diameter× 10.9 meter, or 1.8 meter×10.9, or 2.1 meter×10.9 meter or 2.7 meter×12.1 meter long NM barrel. The scrolled barrel is fitted with a shale dewatering cone and barrel thrust ring. The barrel 7 is rated to deal with an average feed rate of 350 tonnes per hour peaking at 450 tonnes per hour.

The preliminary separator 7 rotates at a speed above about 4 rpm and preferably between about 18 to 22 rpm. In a most preferred embodiment, the preliminary separator 7 rotates at about 20 rpm. As shown in FIG. 1, the preliminary separator 7 (barrel) is arranged at an angle to the horizontal. This angle is preferably about 9 degrees to the horizontal.

Preliminary separation takes place in the preliminary separator 7 (barrel) with the heavy rejects material (discard) being scrolled out of the barrel 7 onto a discard dewatering screen 16. The coal bearing medium carries through the barrel and the product floated onto a sizing screen 8 where the +0 to 38 mm material passes through the screen 8 into the primary separator (cyclone) feed tank 9 ready for primary separation. The +38 mm material which passes over the screen will be conveyed to a crusher 15 to be reduced to +0 to 38 mm. The crushed material is then discharged back to the sizing screen 8 and into the primary cyclone feed tank 9 where it will be maintained in suspension for primary separation.

A suitably sized barrel discard dewatering screen 16 is installed. The screen receives non coal bearing discard material rejected from the barrel 7 for final dewatering. The screen 16 will feed the discard material onto the No 1 discard conveyor 19, onto the No 2 discard conveyor 20 and onto a coarse discard heap 46.

The system comprises a primary cyclone feed tank 9 and launder feed tank 17 situated at the product end of the barrel 7. The launder feed tank 17 is fitted with a suitably sized pump 18, which pumps the liquid medium to the barrel launder to wash the feed material into the barrel 7 for preliminary separation.

The primary cyclone feed tank 9 is fitted with suitably sized pump(s) 10, which pump the barrel product (medium containing typically about 70% coal and 30% dirt) to the primary cyclone system 21, 22 for primary separation.

The primary cyclone system 21, 22 comprises a series of ATH horizontal NM primary cyclones installed at the washing plant which have the capability of dealing with dirt materials having a range of coal contents from 4% up to 70%, enabling the system to deal with materials having 4% coal and 96% dirt as well as dealing with materials with 70% coal and 30% dirt. Each cyclone 22 has a discard capacity of 80 tonne per hour and a coal capacity of 30 tonne per hour. Material is pumped from the primary cyclone feed tank 9 to the cyclones 22 for primary separation.

The medium in the primary cyclone is at a specific gravity of between about 1.25 to 1.35, preferably between about 1.27 to 1.32, most preferably at about 1.29. The product (medium carrying typically about 95% coal, 5% dirt) from the primary cyclones 22 passes over a fixed sieve bend 23 for desliming and recovery of the primary medium then into the secondary cyclone feed tank 27 where the product is maintained in suspension within a lower specific gravity secondary medium, the medium being water and shales from the infeed material mixed to reach a predetermined density; the secondary medium is achieved through the dilution of the primary medium by the addition of fresh water, to a predetermined density, typically having a specific gravity in the range of about 1.2 to 1.249, preferably between about 1.21 and 1.24, most preferably about 1.225. The secondary feed tank 27 is fitted with suitably sized pumps which pump the product to the secondary cyclone system 29, 30 for secondary separation.

The discard rejected from the primary cyclones 22 is discharged onto static sieve bends 31 for desliming and recovery of medium then onto the cyclone discard dewatering screen 32 fitted with clean water spray bars for final desliming, rinsing and dewatering.

A suitably sized discard dewatering screen 32 is installed to dewater the cyclone discard. The screen 32 receives discard material from both the primary 22 and secondary 30 cyclone separators, for final dewatering. The screen 32 is capable of processing 150 tonne per hour of discard and forwards the dewatered material on to the No 1 discard conveyor.

The secondary cyclone system 29, 30 comprises a series of ATH horizontal N M secondary cyclones installed at the washing plant. Each cyclone 30 has a discard capacity of 80 tonne per hour and a coal capacity of 30 tonne per hour. Material is pumped at a pressure into the cyclone of between 13-16 psi and preferably at 16 psi, from the secondary cyclone feed tank 27 to the cyclones 30 for secondary separation.

Both primary and secondary cyclones 22, 30 are designed to deal with materials with a size range of +0 to 38 mm. They each have an adjustable vortex and spigot providing the ability to adjust the cut point within the cyclone so enabling control over the coal quality produced.

The discard rejected from the cyclones 30 is discharged onto the static sieve bend 31 for primary dewatering and recovery of medium and then onto the cyclone dewatering screen 32 for final desliming and dewatering.

The coal product, 97% coal and 3% dirt and slime adhering from the medium, is delivered onto a series of static sieve bends 24 and 25 for desliming, dewatering and recovery of secondary medium and then onto the coal product dewatering screen 26.

The dewatering screen 26 comprises a suitably sized single-deck dewatering screen and the coal product from the secondary cyclone system 29, 30 passes over the screen for primary dewatering and rinsing before being forwarded to the coal centrifuge 33. On discharge from the screen the coal quality will range from 99.5 to 100% coal, but preferably 100%, with all the dirt and slimes form the medium having been rinsed off the product.

The screen 26 is capable of processing in excess of 90 tons per hour of coal product.

The coal centrifuge 33 is installed to dewater the coal product delivered from the coal dewatering screen. A conveyor 34 is installed to collect the coal from the coal centrifuge 33.

Coal from the conveyor will be discharged directly onto the radial coal stock out conveyor for final disposal.

In the manner described above, a feed of contaminated coal can be separated to provide clean coal having high purity. The process described above covers the feature of washing the coal twice whereby the first two stages of separation ensure that only dirt is discarded the final stage, then selects the quality of coal required when it cuts out any and all remaining dirt and coal which are outside the required specification.

A flexible feature of the method/system is that by changing the valves in the flow lines from the primary cyclones 22 the system can be changed to washing the dirt twice. This approach may well be adopted where the yields are low within the feed material and in such a case the system, instead of selecting the coal material be quality, will be scavenging the coal out of the dirt to the required specification.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A method of separating coal from spoil/reject heaps containing coal, the method comprising:

a primary separation of:

(i) adding a portion from the spoil/reject heap containing coal to a liquid medium, (ii) adjusting the specific gravity of the liquid medium carrying the portion from the spoil/reject heap containing coal to a first specific gravity by adding water and mineral dirt;

(iii) causing the liquid medium carrying the portion from the spoil/reject heap containing coal at the first specific gravity to undergo primary separation; and a secondary separation of:

(iv) adjusting the specific gravity of the liquid medium carrying the portion from the spoil/reject heap containing coal from the first separator to a second specific gravity by adding water and mineral dirt in which the second specific gravity is lower than the first specific gravity; and (v) causing the liquid medium carrying the portion from the spoil/reject heap containing coal at the second specific gravity to then undergo secondary separation thereby producing a clean coal product having at least 95% purity, wherein:

the first specific gravity is between about 1.25 to 1.35, and the second specific gravity is between 1.15 to 1.249.

2. A method according to claim 1, wherein the second specific gravity differs from the first specific gravity by at least from 0.001 to 0.1.

3. A method as claimed in claim 1, wherein primary separation is undertaken in primary separation means.

4. A method as claimed in claim 3, wherein the primary separation means comprises a primary cyclone.

5. A method as claimed in claim 4, wherein the primary cyclone operates at between 10 and 20 psi.

6. A method as claimed in claim 4, wherein the primary cyclone receives a feed material having particulates up to about 50 mm.

7. A method as claimed in claim 6, wherein secondary separation is undertaken in secondary separation means.

8. A method as claimed in claim 7, wherein the secondary separation means comprises a secondary cyclone.

9. A method as claimed in claim 8, wherein the secondary cyclone operates at between 10 and 20 psi.

10. A method as claimed in claim 8, wherein the secondary cyclone is adapted to receive a feed material having particulates up to about 50 mm.

11. A method as claimed in claim 1, further comprising a preliminary separation step, wherein only water is added to the portion from the spoil/reject heap containing coal before step (i).

12. A method as claimed in claim 11, wherein the preliminary separation is undertaken in preliminary separation means.

13. A method as claimed in claim 12, wherein the preliminary separation means rotates, in use.

14. A method as claimed in claim 13, wherein the preliminary separation means rotates about a longitudinal axis thereof, in use.

15. A method as claimed in claim 14, wherein the preliminary separation means rotates at a rate of between about 4 and 50 rpm, in use.

16. A method as claimed in claim 12, wherein the preliminary separation means may comprise a separating barrel.

17. A method as claimed in claim 12, wherein the preliminary separation means is arranged on a slight incline.

18. A method as claimed in claim 17, wherein a longitudinal axis of the preliminary separation means is arranged at between about 5 and 15 degrees to the horizontal.

19. A method as claimed in claim 1, wherein the specific gravity of the liquid medium carrying the portion from the spoil/reject heap containing coal of step (ii) is adjusted to the first specific gravity by the addition consisting essentially of the water and the mineral dirt, wherein the mineral dirt of the first mixture is selected from the group consisting of mudstones, shales, coal, sandstone, and clay.

20. A method as claimed in claim 19, wherein the specific gravity of the liquid medium carrying the portion from the spoil/reject heap containing coal from the first separator of step (iv) is adjusted to the second specific gravity by the addition consisting essentially of the water and the mineral dirt, wherein the mineral dirt of the second mixture is selected from the group consisting of mudstones, shales, coal, sandstone, and clay.

* * * * *